United States Patent [19]

Hampson

[11] Patent Number: 4,516,411

[45] Date of Patent: May 14, 1985

[54] LOOP HOLD-DOWN DEVICE FOR USE IN CONJUNCTION WITH A KNITTING MACHINE

[75] Inventor: Jack T. Hampson, Belper, England

[73] Assignee: J & P Coats, Limited, Glasgow, Scotland

[21] Appl. No.: 559,759

[22] Filed: Dec. 9, 1983

[30] Foreign Application Priority Data

Dec. 9, 1982 [GB] United Kingdom ..... 8235148

[51] Int. Cl.[3] ..... D04B 7/04

[52] U.S. Cl. ..... 66/64

[58] Field of Search ..... 66/60, 604, 64

[56] References Cited

U.S. PATENT DOCUMENTS

| | | | |
|---|---|---|---|
| 3,685,317 | 8/1972 | Giachetti | 66/64 |
| 4,402,196 | 9/1983 | Kuhnert | 66/64 |
| 4,433,560 | 2/1984 | Betts | 66/64 |
| 4,442,683 | 4/1984 | Shima et al. | 66/64 |
| 4,463,577 | 8/1984 | Schimko et al. | 66/64 |

*Primary Examiner*—Ronald Feldbaum

*Attorney, Agent, or Firm*—Larson and Taylor

[57] ABSTRACT

A loop hold-down device for a flat bed knitting machine incorporates a carrier member attachable to the needle actuating carriage of the machine, two spaced parallel rods rotatable about their axes and also reciprocable in the carrier member in a direction which is vertical when the carrier member is attached to said movable carriage and a loop hold-down element attached to and projecting from the lowermost end of each rod. Each rod is slidable in a sleeve which is itself rotatable but restrained against reciprocation in the carrier member, each rod being entrained by the sleeve to rotate therewith. A driving band interconnects the two sleeves whereby to cause both sleeves to rotate together, two sliding blocks are slidable vertically in the carrier member, each block engaging a respective rod and each formed with a cam follower engageable with a cam surface located at each end of the ned of the knitting machine whereupon each cam follower causes the associated rod to reciprocate in the sleeve. An actuating bar is connected to the driving band and is engageable alternately with an abutment located at each end of the knitting machine as the carriage moves to and fro so that the bar is also movable to and fro in the carrier member, moving with it the driving band.

8 Claims, 5 Drawing Figures

LOOP HOLD-DOWN DEVICE FOR USE IN CONJUNCTION WITH A KNITTING MACHINE

Figure 1:
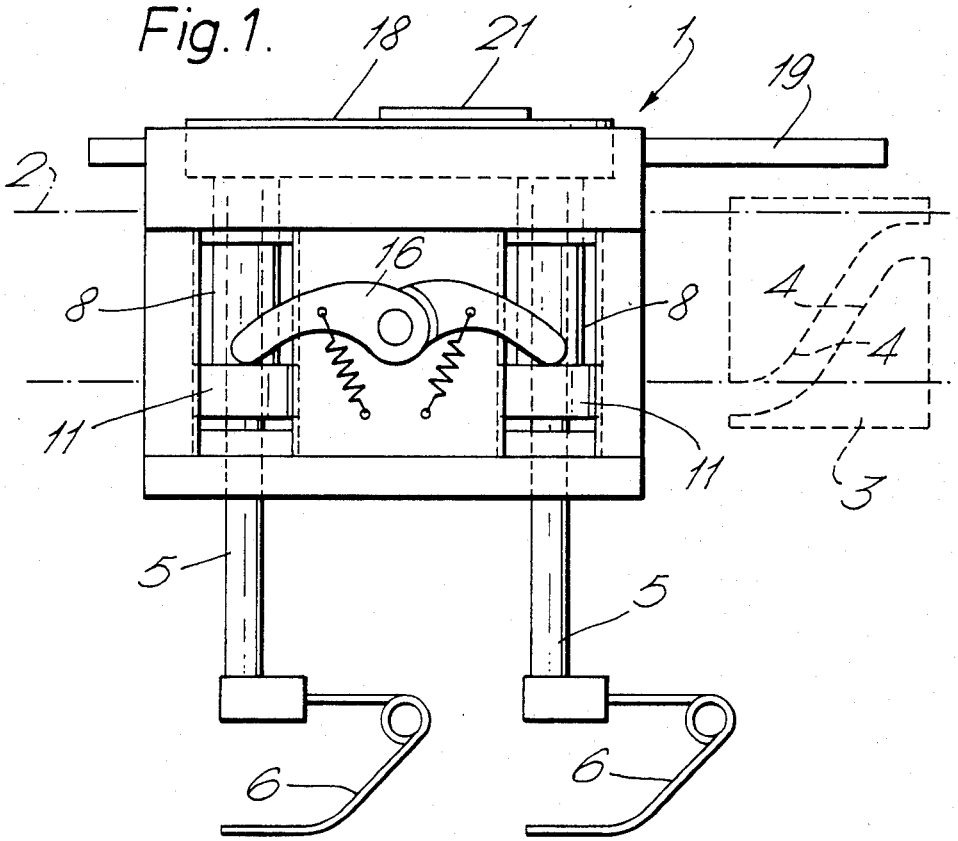

The subject of this invention is a loop hold-down device for fitting to a knitting machine, particularly a knitting machine of the flat V-bed type having at least two sets of latch needles normally movable diagonally across one another between raised and lowered positions by action of a cam as a carriage carrying the cam moves to and fro across the bed of the machine.

In normal operation of such a machine the loops of yarn being knitted must slide down the raised needles after being formed so that they slip over the latches on to the shanks of the needles preparatory to closing the latches as the needles are retracted. The conventional method of achieving this object is to attach a weight to the end of the formed fabric, the weight causing the fabric to be pulled downwardly thus causing each loop when formed to be pulled down the shank of the associated needle and over the latch. For the performance of certain knitting operations it is necessary to hold one set of needles static and inoperative with loops of fabric on them while the other set of needles, the active needles, continues knitting. In this case the necessary tension to pull the loops on the active needles down the shanks of the needles cannot be obtained by weights on the knitted fabric because the pull of the weights is supported by the loops on the static needles which are further down the knitted fabric than the loops on the active needles. The result is that the loops on the active needles do not move down over the latches on the active needles as they are formed and a proper knitting action cannot be obtained. Several mechanisms for moving the loops of the active needles are available all incorporating loop hold-down elements, sometimes referred to as presser feet which press into the groove at the junction line formed by the intersection of the layer of fabric being knitted on the active needles and the layer of fabric being held static on the static needles. One known construction incorporates an arm swingable about a horizontal axis, the lower end of the arm engaging said groove. Some form of longitudinal movement is necessary because the loop hold-down element must be clear of and in advance of the point where knitting is actually taking place and since knitting takes place in both directions of movement of the carriage on such a knitting machine it is necessary for a loop-hold down element always to be present in advance of the knitting point as the direction of knitting reverses across the piece being knitted. The swing arm provides this effect but suffers from the disadvantage that according to the size of the angle of swing the position assumed by the part of the arm in contact with the groove changes. Also according to the size of the angle of swing the longitudinal position of the part of the arm in contact with the groove i.e. its distance from the knitting point, varies.

In another construction two loop hold-down elements spaced along the length of the needle rows are alternately engageable with the portion of the groove in advance of the knitting point in each direction of movement of the carriage, each loop hold-down element being alternately operative in the to and fro movement of the carriage.

There has been previously described in patent specification No. GB 1 566 137 a loop hold-down device incorporating a carrier member attachable to the carriage customarily provided in a flat knitting machine to traverse the needle bed and actuate the needles, at least one rod supported by the carrier member and reciprocable in a vertical direction with respect to the normal direction of movement of the carriage and rotatable about its axis, a loop hold-down element attached to the lower end of the rod, means for reciprocating the rod, said means comprising a cam plate slidable in the carriage and engageable with an abutment at each end of the knitting machine to which the device is fitted as the carriage moves to and fro along the needle bed, said cam plate presenting a cam surface engaged by a cam follower engaging in turn the rod so that vertical movement of the cam follower communicates vertical movement to the rod and a cam element mounted on the carrier member and presenting a helical cam face which is engaged by a cam follower on the rod during the time when the rod is performing the final part of its upward movement so that during said final part of its upward movement the rod is rotated by the cam through an angle of 180°.

The form of loop hold-down device described above operates quite well but in certain circumstances the loop hold-down element tends to foul the yarns approaching the knitting position as the rod is being rotated at the end of the carriage movement. This happens because the rod is rotated by the helical cam while it is moving upwards out of the V groove formed by the yarns and needles at the knitting point and thus before the loop hold down element is completely clear of the yarns. It is an object of the present invention to provide a construction in which the loop hold down element cannot interfere with the yarns approaching the knitting point.

A loop hold down device according to the invention incorporates a carrier member attachable to the needle actuating carriage customarily forming part of a flat knitting machine and movable to and fro along the needle bed of the machine, two spaced parallel rods rotatable about their axes and also reciprocable in the carrier member in a direction which is vertical when the carrier member is attached to said movable carriage and a loop hold-down element attached to and projecting from the lowermost end of each rod, i.e. the end which is lowermost when the device is attached to the carriage characterized in that each rod is slidable in a sleeve which is itself rotatable but restrained against reciprocation in the carrier each rod being entrained by the sleeve to rotate therewith, a driving band interconnects the two sleeves whereby to cause both sleeves to rotate together, two sliding blocks are slidable vertically in the carrier member, each block engaging a respective rod and each formed with a cam follower engageable with a cam surface located at each end of the bed of the knitting machine and arranged to move each cam follower and cause the associated rod to reciprocate in the sleeve and an actuating bar slidable in the carrier member in a direction parallel with the direction in which the carriage is movable, said actuating bar being connected to the driving band and being engageable with an abutment located at each end of the knitting machine as the carriage moves to and fro so that the bar is also movable to and fro in the carrier member, moving with it the driving band.

Each sleeve may be fitted with a toothed wheel and the driving band may be a toothed belt. Alternatively the wheel fitted to each sleeve may be a sprocket wheel and the driving band may be a chain.

Each sleeve may be formed with an axial slot and each rod may be fitted with a pin penetrating the slot in the associated sleeve so that the rod may slide in the sleeve but must rotate therewith.

Each sliding block engaged with the respective rod may be connected to the bar by way of the pin which penetrates the slot in the sleeve.

The carrier member may be formed with guide surfaces engaged with the bar customarily extending from one end of a knitting machine to the other and carrying the cam surfaces engageable by the cam followers carried by the sliding blocks, said carrier member being formed also with guide surfaces parallel with the sleeve in which the sliding blocks are reciprocable in a vertical direction and may also be formed with two upwardly extending projections through which passes the actuating bar and between which the attachment of the actuating bar to the driving band is located.

The actuating bar may be connected to the driving band by way of a coupling element which is a friction fit on the actuating bar, the upwardly extending projections serving as stops for said coupling element.

Figure 3:
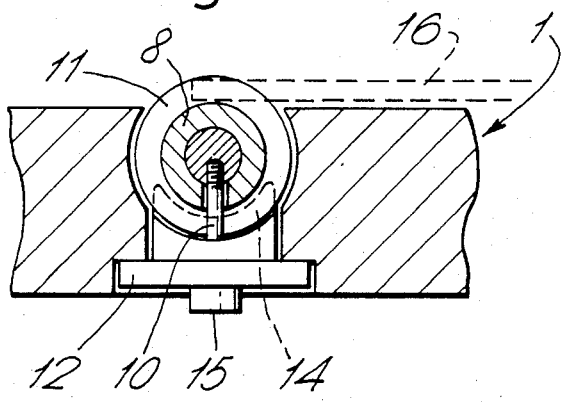
Figure 2:
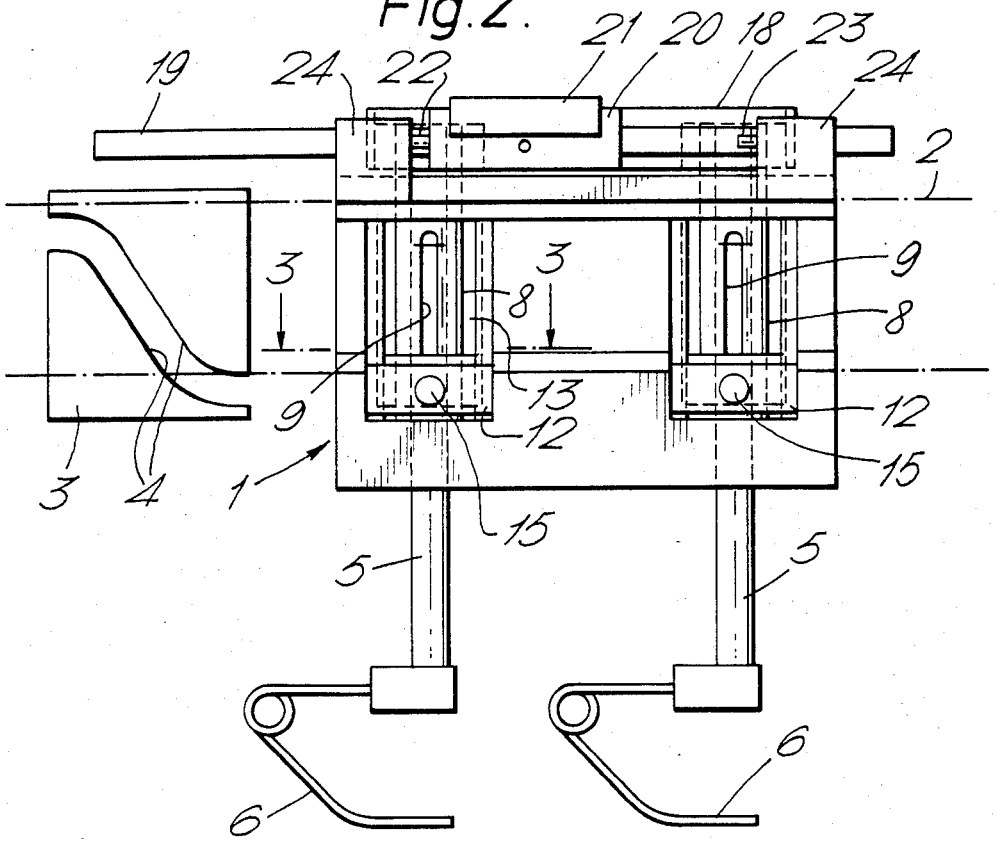
Figure 4:
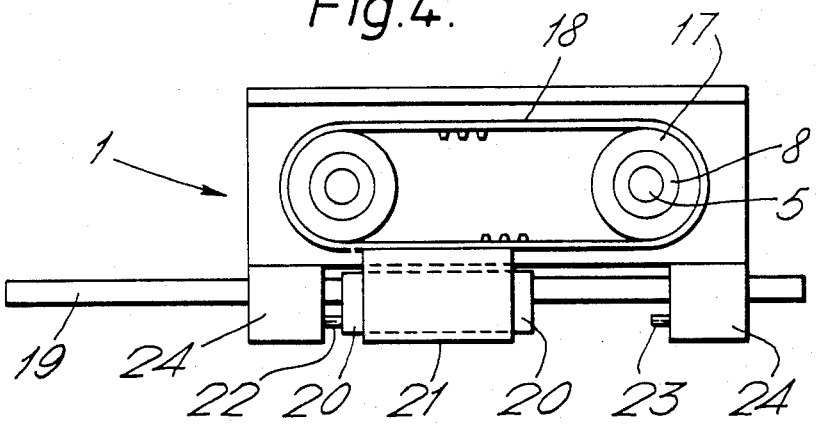
Figure 5:
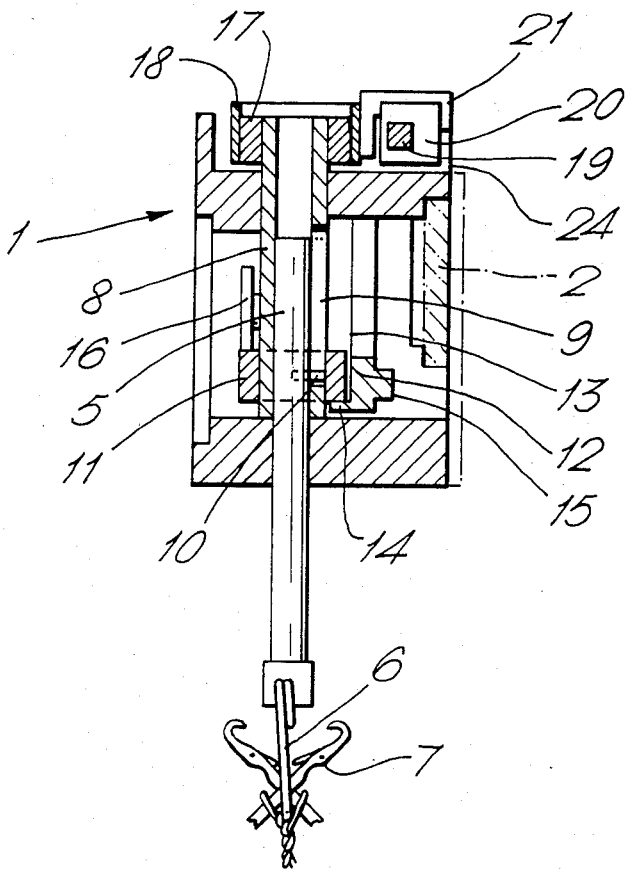

A practical embodiment of the invention is illustrated in the accompanying drawings in which FIG. 1 illustrates the device looking on the front of the device as seen from the operating position of the knitting machine, FIG. 2 shows the device from the rear with part of it removed to show the sliding blocks and the sleeves, FIG. 3 is a section through the line 3—3 in FIG. 2, FIG. 4 is a plan view of the device as illustrated in FIG. 2 and FIG. 5 is a section through the line 5—5 in FIG. 1 showing the relationship of the device to the needle bed of a knitting machine to which the device is fitted.

In the drawings 1 denotes generally a carrier member mounted on a bar 2 which is customarily a part of a knitting machine and extends the full length of the needle bed parallel with the needle bed. The bar 2 carries at each end a cam 3 formed with a cam surface 4. 5 denotes rods reciprocable and rotatable in the carrier member 1, the rods carrying attached to their lower ends loop hold-down elements 6 engageable with the groove formed by opposite loops on the needles 7 constituting the needle bed (See FIG. 5). Each rod 5 is slidable within a respective sleeve 8 rotatable but not reciprocable in the carrier member 1 and formed with a slot 9 penetrated by a pin 10 which constrains the rod 5 to rotate with the sleeve 8 while being free to reciprocate within the sleeve 8. The pin 10 of each rod projects into a bush 11 encircling the respective sleeve 8 and is slidable therealong. 12 denotes sliding blocks one for each rod 5, each sliding block being slidable in guides 13 formed in the carrier member 1 and being formed with a projecting ridge 14 which engages under the bush 11. Each block 12 also presents a cam follower 15 which is engageable with the cam surfaces 4 presented by the cams 3 on the bar 2. 16 denotes spring-loaded fingers engaging the tops of the bushes 12 whereby to urge the bushes to move downwardly taking with them the rods 5. The top ends of the sleeves 8 are fitted with toothed wheels 17 which are connected by a toothed driving band 18. Slidable in guideways located at the top of the carrier member 1 is an actuating bar 19 reciprocable in a direction parallel to the bar 2. The actuating bar 19 carries, frictionally engaged therewith a coupling element 20, which engages a block 21 fastened to the driving band 18, the coupling element 20 being movable between stops 22 and 23 constituted by upwardly extending projections 24 on the carrier member 1. The element 20 is frictionally engaged with the actuating bar 19 so that normally while the bar 19 will communicate reciprocating movement to the element 20, if the element 20 comes against one of the stops 22 or 23 and the bar 19 has not completed its sliding movement the element 20 will slide on the bar 19.

In operation of a knitting machine to which the device illustrated in the drawings is fitted, as the carrier member moves the carriage along the groove between the needles in the needle bed i.e. the acute angle between the needles 7 in one direction during the action of knitting, the needle operating cam raises and lowers consecutively the needles of one row (the "active needles") and leaves the needles of the other row static, the "static needles" retaining the loops previously formed thereon on the previous traverse of the carriage when they were the active needles. Assuming that the carriage is moved to the right as illustrated in the drawings the carrier member 1 which is attached to the carriage is also moved to the right. During the movement to the right the two loop hold-down elements 6 press into the groove between the needles 7 and hold the loops down. As the elements 6 are disposed one in advance and one behind the knitting position the loops on the active needles are held down so that they can engage the latches on the active needles as these needles are raised by the cam when the carriage moves along the needle bed.

When the carriage approaches the right hand end of the needle bed bearing with it the carrier member 1 the cam 3 on the right hand end engages first the cam follower 15 presented by the sliding block 12 associated with the leading rod 5 causing the rod 5 to slide in the associated sleeve 8 against the spring thrust of the associated finger 16, the pin 10 engaging the slot 9 in the associated sleeve 8 preventing the bar 5 from rotating in the sleeve 8. Continued movement of the carrier member then brings the cam follower 15 of the trailing rod 5 into engagement with the cam surface 4 of the cam 3 and this rod is also raised against the movement of its sprung finger 16. Both loop hold down elements 6 are now raised completely clear of the V-groove between the needles but are still in their "trailing" position with respect to the groove between the needles. Continued movement of the carriage and the carrier member 1 towards the right now causes the actuating bar 19 to come into contact with an abutment at the end of the machine which the carrier member is now approaching. The actuating bar 19 is stopped by the abutment while the carrier member continues to move towards the end of the machine. The actuating bar 19 is thus moved relatively to the carrier member 1. The coupling element 20 which has a frictional grip on the actuating bar 19 is moved along with the bar 19 and takes with it the block 21 attached to the driving band 18 so that the driving band 18 is caused to circulate and set in rotation and in step with one another the two wheels 17, thus rotating the sleeves 8. The rods 5 being entrained by the sleeves 8 by way of the pins 10 are now also caused to rotate and swing the loop hold-down elements through 180°. Any slight maladjustment of the longitudinal position of the bar 19 which might cause excessive force to be generated when the coupling element 20 comes against the stop 22 is taken care of by the frictional grip of the coupling element 20 on the bar 19, said element 20 merely sliding along the bar 19. The carriage and the carrier member 1 are now at the end of their right hand traverse and commence their movement towards the opposite end of the bed. This reversal of movement causes the cam followers 15 to return in a downward direction moving the slide blocks 11 with them. The spring loaded fingers 16 pressing against the upper surfaces of the bushes 11 cause the rods 5 to slide downwards so that the loop hold-down elements 6 again enter the V-groove between the needles 7 but this time they are projecting to the rear with regard to the new direction of movement of the carriage so that they can move smoothly along the V-groove between the needles 7 towards the other end of the machine bed at which the operation just described is repeated in reverse, i.e. raising and rotating the loop hold-down elements 6 to cause them to project again to the left ready for the next traverse back to the right hand end of the machine.

I claim:

1. A loop hold-down device incorporating a carrier member attachable to the needle actuating carriage customarily forming part of a flat knitting machine and movable to and fro along the needle bed of the machine, two spaced parallel rods rotatable about their axes and also reciprocable in the carrier member in a direction which is vertical when the carrier member is attached to said movable carriage and a loop hold-down element attached to and projecting from the lowermost end of each rod, i.e. the end which is lowermost when the device is attached to the carriage in which two sleeves are mounted in the carriage to be rotatable but restrained against reciprocation in the carrier, each rod is slidable in a respective sleeve and is entrained by the sleeve to rotate therewith, a driving band interconnects the two sleeves whereby to cause both sleeves to rotate together, two sliding blocks are slidable vertically in the carrier member, each block engaging a respective rod and each formed with a cam follower engageable with a cam surface located at each end of the bed of the knitting machine and thereupon to be operable to cause the associated rod to reciprocate in the sleeve and an actuating bar slidable in the carrier member in a direction parallel with the direction in which the carriage is movable, said actuating bar being connected to the driving band and being engageable with an abutment located at each end of the knitting machine as the carriage moves to and fro so that the bar is also movable to and fro in the carrier member, moving with it the driving band.

2. A loop hold-down device as claimed in claim 1 in which each sleeve is fitted with a toothed wheel and the driving band is a toothed belt.

3. A loop hold-down device as claimed in claim 1 in which the wheel fitted to each sleeve is a sprocket wheel and the driving band is a chain.

4. A loop hold-down device as claimed in claim 1 in which each sleeve is formed with an axial slot and a pin penetrating the slot in the associated sleeve is fitted to each rod.

5. A loop hold-down device as claimed in claim 4 in which each sliding block engaged with the respective rod is connected to the bar by way of the pin which penetrates the slot in the sleeve.

6. A loop hold-down device as claimed in claim 1 in which the carrier member is formed with guide surfaces engaged with the bar customarily extending from one end of a knitting machine to the other and carrying the cam surfaces engageable by the cam followers carried by the sliding blocks, said carrier member being formed also with guide surfaces parallel with the sleeve in which the sliding blocks are reciprocable in a vertical direction.

7. A loop hold-down device as claimed in claim 1 in which the carrier member is formed with two upwardly extending projections through which the actuating bar passes and between which the attachment of the actuating bar to the driving band is located.

8. A loop hold down device as claimed in claim 1 in which a coupling element connects the actuating bar to the driving band, the coupling element being a friction fit on the actuating bar, the upwardly extending projections serving as stops for said coupling element.

* * * * *